United States Patent [19]

Stephenson et al.

[11] 4,278,188

[45] Jul. 14, 1981

[54] REMOTE DELIVERY NOZZLE ASSEMBLY FOR PRESSURIZED CONTAINER

[75] Inventors: George M. Stephenson, 190 Chestnut Ridge, Bethel, Conn. 06801; David E. Begin, Brookfield, Conn.

[73] Assignee: George M. Stephenson, Bethel, Conn.

[21] Appl. No.: 80,589

[22] Filed: Oct. 1, 1979

[51] Int. Cl.[3] ..... B67D 5/06

[52] U.S. Cl. ..... 222/182; 222/402.14; 285/200

[58] Field of Search ..... 222/182, 402.1, 402.13, 222/402.14, 527, 529, 562, 563; 401/190; 285/200

[56] References Cited

U.S. PATENT DOCUMENTS

| | | | |
|---|---|---|---|
| 3,269,614 | 8/1966 | Abplanalp | 222/182 X |
| 3,273,610 | 9/1966 | Frost | 222/402.14 X |
| 3,395,838 | 8/1968 | Beres et al. | 222/402.14 |
| 3,650,438 | 3/1972 | Stephenson et al. | 222/402.22 |

OTHER PUBLICATIONS

Remote Delivery Nozzle Assembly Photograph (Paper No. 2) submitted by applicant.

*Primary Examiner*—Robert J. Spar
*Assistant Examiner*—Fred A. Silverberg
*Attorney, Agent, or Firm*—Barry Kramer

[57] ABSTRACT

A remote delivery nozzle assembly is adapted to be releasably connected to a pressurized container to permit delivery of the pressurized contents thereof to a location remote from the container. A connector assembly flowably connects one end of a delivery conduit to the valve stem of the container while a manually operable valve and nozzle coupled with the other end of the delivery conduit provides remote control of the release of the pressurized contents. The connector assembly comprises a hollow cap which frictionally engages an upstanding, annular rim of the container and completely encloses the valve stem. A connector element extends through the aperture in the top of the cap in aligned relationship to the valve stem, and is secured to the cap by frictional engagement therewith. An O-ring interposed between the connector element and the top of the cap provides a gas tight seal therebetween. The connector element has a bore therethrough which respectively receives the valve stem of the container and the flexible conduit in opposite ends thereof to couple the remote delivery nozzle with the contents of the container. Installation of the cap onto the container rim simultaneously couples the connector element with the valve stem while depressing the latter, thereby automatically arming the remote delivery nozzle.

5 Claims, 4 Drawing Figures

REMOTE DELIVERY NOZZLE ASSEMBLY FOR PRESSURIZED CONTAINER

TECHNICAL FIELD

The present invention generally relates to nozzle assemblies for pressurized containers, and deals more particularly with an improved connector assembly for coupling a flexible conduit with the valve stem of a container in order to allow delivery of the pressurized contents of the container to a location remote from the container.

BACKGROUND AND BRIEF DESCRIPTION OF THE INVENTION

Portable pressurized containers such as pressurized aerosol cans are employed in numerous industrial applications where space limitations require that the container be fitted with a remote delivery nozzle in order to permit the container to be positioned at a distance from the work station where the contents of the container are used. For example, in removing dust particles from optical assemblies, in cleaning intricate mechanisms and minute electrical components, as well as other miniturized precision assemblies, the manipulation of a pressurized container of solvent or compressed gaseous cleaning agent is impossible unless a remote delivery nozzle is employed which may be easily manipulated and introduced into proximity with the product to be treated.

One such remote delivery nozzle is disclosed in U.S. Pat. No. 3,650,438 assigned to the assignee of the present application, the disclosure of which patent is hereby incorporated by reference herein. The nozzle disclosed in such prior patent comprises a pressure control assembly mounted on the top of the pressurized container and also includes an eccentric connector coupling the valve stem of the container to an elongate flexible tube employed to deliver the pressurized contents to a remote release nozzle. An eccentrically-apertured rotatable container cap cooperates with the eccentric connector to tilt the valve stem of the container when the cap is rotated thereby supplying "arming" pressure from the container through the flexible conduit to the manually actuated remote release nozzle.

While this prior art remote delivery nozzle is satisfactory in most respects, it is subject to several serious objections. For example, the eccentric connector and valve cap require precise alignment in order to operate properly and are not entirely suitable for use with those types of pressurized cans having a valve stem assembly which requires substantial downward movement, rather than merely tilting thereof, in order to allow escape of the pressurized contents through the valve stem. More significantly, because the eccentric connector extends through an eccentric aperture in the valve cap, minor leakage of the pressurized contents between the valve stem of the container and the eccentric connector sometimes occurs which results in escape of the contents through the aperture in the cap, thereby wasting the contents. Also, because the user is required to fit the eccentric connector onto the valve stem of the container prior to fitting the cap onto the container, the valve stem is often tilted or depressed during the fitting thereof with the eccentric connector, thereby allowing escape of the contents between the valve stem and the eccentric connector, which in some cases is not only wasteful but also contaminates the area adjacent the container.

It is therefore an important object of the present invention to provide a connector assembly particularly adapted for use with a remote delivery pressurized container nozzle which is not only simple, and therefore economical from a manufacturing standpoint, but may be easily and quickly fitted to a pressurized container in a manner which prevents inadvertent escape of the contents from the can.

According to the present invention, a connector element extends through the top of a cylindrically shaped cap which is adapted to frictionally engage the upstanding annular rim on a standard aerosol can type container. The connector element is secured to the cap by means of a friction fit interlock while an O-ring provides sealing engagement between the connector element and the cap whereby to provide a gas tight enclosure surrounding the valve stem of the container. The connector element includes a elongate bore therethrough into the opposite ends of which the valve stem of the container and a flexible conduit are respectively received. The connector element includes shoulder portions within the bore which sealingly engage the end of the valve stem and urge the latter downwardly to release the pressurized contents when the cap is fitted onto the pressurized container. The connector assembly is installed on the container by merely fitting the cap onto the upstanding rim of the container, thereby eliminating the need for separately aligning and fitting the connector element onto the valve stem before the cap is installed. Once installed on the container, the connector assembly automatically arms the remote delivery nozzle. Disarming is effected simply by removing the cap from the container.

DESCRIPTION OF THE DRAWINGS

In the drawings, which form an integral part of the specification and are to be read in conjunction therewith, and in which like parts are represented by like reference numerals in the various views.

DETAILED DESCRIPTION OF THE INVENTION

Figure 1:
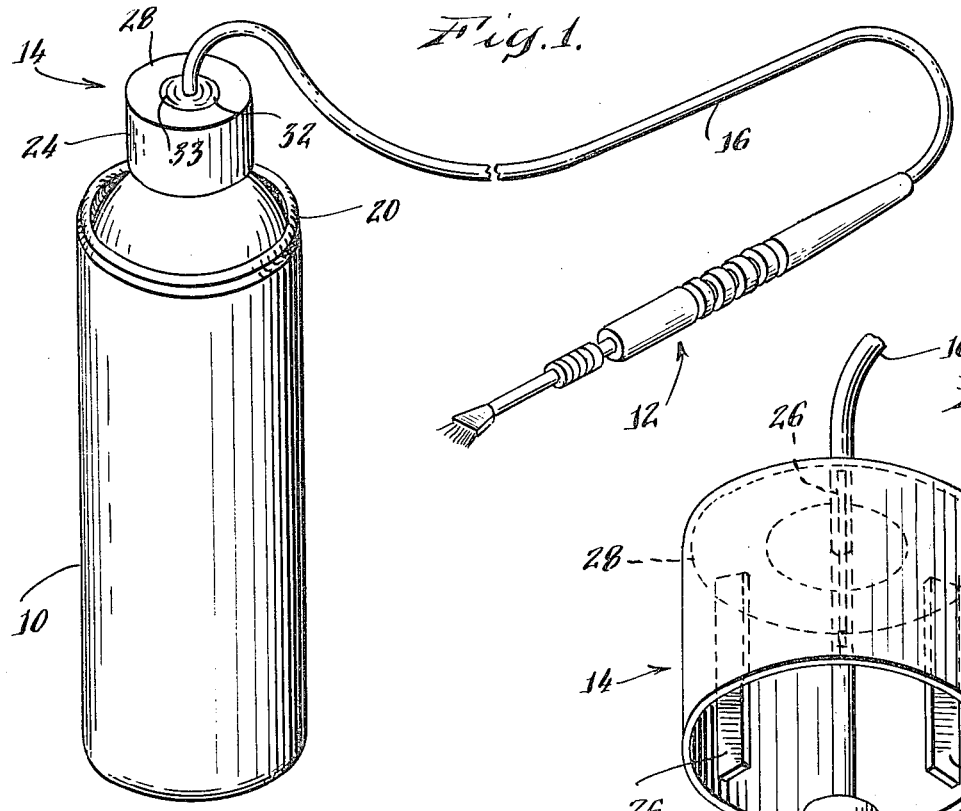
FIG. 1 is a perspective view of a remote delivery nozzle installed on a pressurized container.
Figure 2:
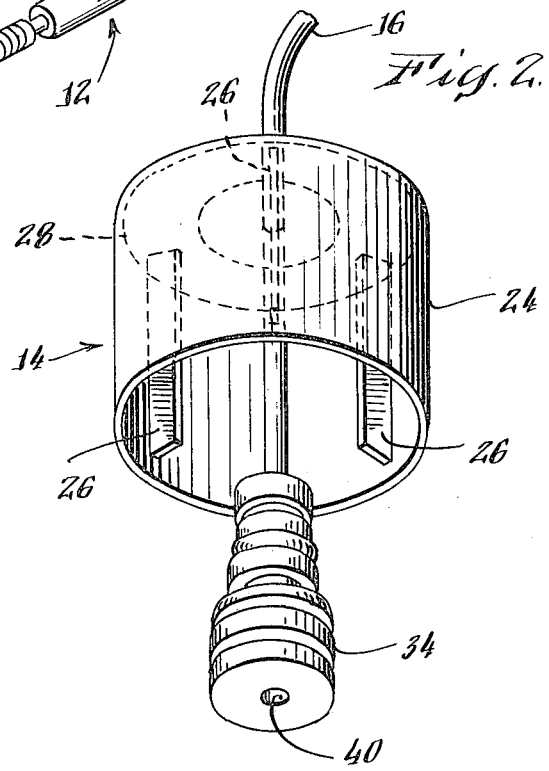
FIG. 2 is an exploded perspective view of the connector assembly which forms the preferred embodiment of the present invention, shown removed from the container.
Figure 4:
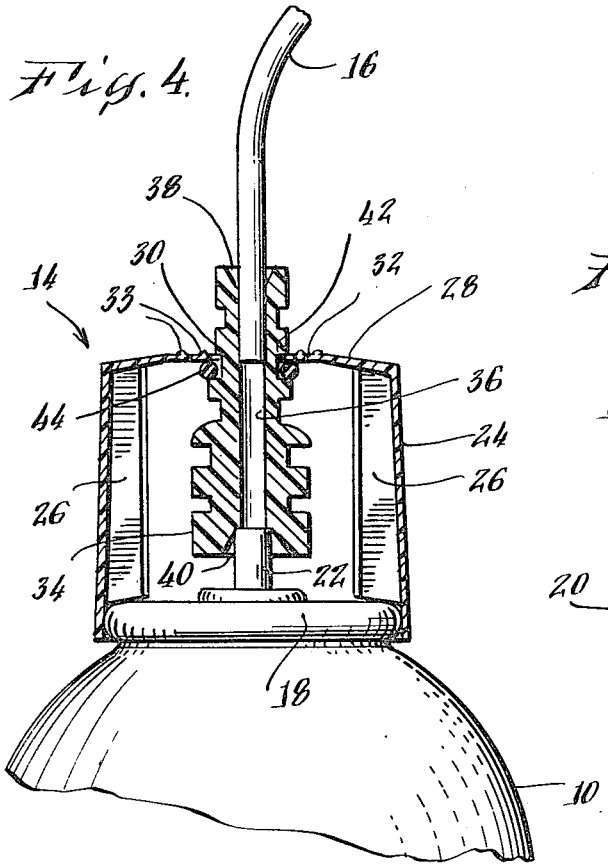
FIG. 4 is a sectional view taken along the line 4—4 in FIG. 3.
Figure 3:
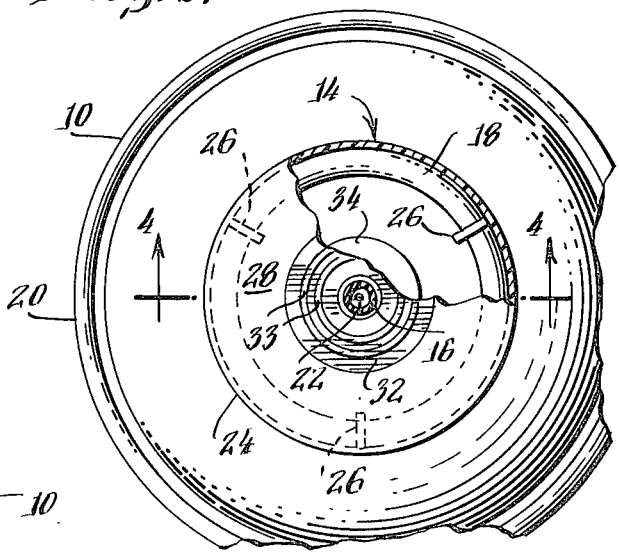
FIG. 3 is a fragmentary, top view of the container with the connector assembly installed thereon, parts of the cap being broken away in section for clarity.

Referring now to FIGS. 1-4, a portable pressurized container, such as an ordinary pressurized aerosol-type container can 10 has a remote delivery nozzle 12 flowably connected thereto by means of a connector assembly 14 and flexible conduit 16. The container 10 may be filled with any suitable contents under pressure, such as a cleaner or solvent, which is desired to be delivered to a remote location by means of the remote delivery nozzle 12. Container 10 is cylindrical in shape and is provided with inner and outer, annularly shaped, upstanding, concentric rims, 18 and 20 respectively. A storage and shipping cap (not shown) may be installed on the can 10 in frictional engagement with the outer rim 20 when the connected assembly 14 is removed during periods of non-use.

The construction of the remote delivery nozzle 12 is disclosed in U.S. Pat. No. 3,650,438 and therefore need not be described in detail herein. It is to be noted, however, that numerous other types of remote delivery nozzles may be employed in connection with the improved connector assembly of the present invention. The container 10 is provided with an upstanding, hollow valve stem 22 which is centrally disposed in the top of the container 10. The valve stem 22 forms a part of a valve arrangement which is manufactured integral with the container 10 and is well known in the art. Such valve arrangement will typically include means (not shown) for biasing the valve stem 22 upwardly, such that a downwardly directed force on the valve stem 22 generally aligned with the longitudinal axis of the container 10 produces downward displacement of the valve stem 22, thereby opening the associated valve and allowing the pressurized contents to flow out of the container 10 through the valve stem 22.

The connector assembly 14 of the present invention includes a hollow, cylindrically shaped cap 24 having a number of circumferentially spaced, longitudinally extending re-enforcement ribs 26 formed integral with the interior side walls thereof to provide the cap 24 with rigidity. One end of cap 24 is enclosed by a top wall 28 which has an aperture 30 centrally therethrough, while the opposite end of the cap 24 is open and possesses an inside diameter marginally less than the outside diameter of the inner rim 18. When installed on the container 10, the inner surface of the cap 24 frictionally engages the inner rim thereby tightly holding the cap 24 on the container 10 while lower edges of each of the ribs 26 contact the top of the inner rim 18 to limit the downward movement of the cap 24 relative to the inner rim 18.

The cap 24 is preferably made of a flexible plastic material and may include an annular, preformed area of weakness 32 circumscribing the aperture 30 to provide increased flexibility of the material immediately adjacent the aperture 30. Such area of weakness 32 may be formed, for example, by reducing the thickness of the material around the aperture 30 in which case it is desirable to provide a plurality of radially spaced, annular reinforcement ribs 33 integral with the top wall 28 to prevent tearing of the cap material around the aperture 30 when a latter discussed connector element is passed through the aperture 30.

The connector assembly 14 further comprises an elongate connector element 34 having an elongate bore 36 longitudinally therethrough which defines upper and lower openings in opposite extremities thereof, when openings are indicated by the numerals 38 and 40, respectively. The bore 36 possesses a diameter less than the outside diameter of the valve stem 22 and is provided with outwardly tapered side walls adjacent both the upper and lower openings 38 and 40. The tapered side walls of the bore 36 adjacent the opening 40 provide a shoulder area for seating against the upper surface of the valve stem 22 when the connector assembly 14 is installed on the container 10.

The upper portion of the connector element 34 extends through the aperture 30 in the cap 24, while one extremity of the flexible conduit 16 is disposed in slipfit relationship within the bore 36 through the opening 38. Connector element 34 is provided with an annular notch 44 in the exterior side wall thereof, aligned with respect to the top wall 28 of the cap 24. The inside diameter of the annular notch 42 is approximately equal to or marginally larger than the diameter of the aperture 30 in cap 24. An O-ring 44 is matingly received within the annular notch 44, between one side of the notch 42 and the inner surface of the top wall 28, whereby to provide a seal between the connector element 34 and the top wall 28. The O-ring 44 is held in position by virtue of the fact that the annular portion of the top wall 28 defining the aperture 30 is interposed between one side of the annular notch 42 and the O-ring 44.

The connector assembly 14 is initially assembled by first slipping the O-ring 44 around the connector element 14 and into the annular notch 42. The connector element 14 is then inserted through the bottom of the cap 24, thence through the aperture 30 until the edges of the top wall 24 surrounding the aperture 30 snap into place between the O-ring 44 and the upper side of the notch 42. The flexible conduit 16 may be then inserted into the bore 36; in this respect it is noted that the tapering side walls adjacent the opening 38 facilitate rapid alignment and insertion of the end of the conduit 16 into the bore 36. At this point, the connector assembly 14 is fully assembled and may be installed on the container 10 in order to arm the remote delivery nozzle 12. The connector assembly 14 is installed in the container 10 merely by disposing the open end of the cap 24 over the valve stem 22 and force fitting the cap 24 down onto the inner rim 18. As the cap 24 is forced downwardly onto the rim 18, the upper surface areas of the valve stem 22 engage the shoulder area of the side walls defining the bore 36 whereupon force delivered by the user is transmitted from the cap 24 through the connector element 34 downwardly to the valve stem 22 thereby causing the latter to shift downwardly from a normal disarmed mode position to a depressed armed mode position, and release the contents of the container 10 through the bore 36 and conduit 16, thus arming the remote delivery nozzle 12. It can be appreciated from the immediately foregoing description that the valve stem 22 is not shifted downwardly to release the contents until the cap 24 is nearly installed in overlapping relationship to the inner rim 18; by this feature, it becomes apparent that because the valve stem 22 is completely enclosed by the cap 24, the amount of contents, if any, escaping from the connector assembly 14 is minimized. The point at which the valve stem 22 is shifted downwardly sufficient to release the contents of the can 10 will depend in part on the length of the particular valve stem 22. In this regard it may be appreciated that the connector assembly 14 may be readily adapted for use with various types of containers 10 having valve stems of different lengths by merely altering the tapering of the inside walls of bore 36 adjacent opening 40 such that the shoulder area which contacts the valve stem is disposed at the appropriate location along the longitudinal axis of the bore 36.

From the foregoing, it is apparent that the improved connector assembly of the present invention not only provides for reliable accomplishment of the object of the invention but does so in a particularly simple and effective manner. It is recognized, of course, that those skilled in the art may make various modifications or additions to the prefered embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

What is claimed is:

1. An improved remotely operated pressurized container assembly including the combination of a pressurized container provided with an upstanding rim concentrically surrounding an upstanding hollow valve stem for releasing the pressurized contents therefrom in response to shifting of the valve stem relative to the container from a normal disarmed mode position to a depressed armed mode position, a remote delivery nozzle for selectively controlling the release of said contents from said container, conduit means coupled with said remote delivery nozzle for carrying said contents from said container to said remote delivery nozzle, wherein the improvement comprises:

means for releasably connecting said valve stem with said conduit means, said connecting means including (1) cap means for enclosing said valve stem and including an annular peripheral edge frictionally engaging said upstanding rim of said container whereby to removably mount said cap means on said container, said cap means including an aperture therein.

(2) a connector element extending through said aperture in said cap means and secured to the latter, said connector element having a bore therethrough defining first and second openings therein, said first opening being flowably coupled with said conduit means, said valve stem being sealingly received within said bore and extending through said second opening in said connector element, said connector element further including surface portions adapted to engage said valve stem and force the latter to shift from said disarmed mode position thereof to said armed mode position thereof when said cap means is installed on said container, and (3) means circumscribing said connector element for providing a seal between said cap means and said connector element to prevent escape of the contents of said container from said cap means through said aperture into the surrounding atmosphere, said cap means is formed from a plastic material and is tubular in shape, one extremity of said cap means being enclosed by an end wall, said aperture being disposed in said end wall, said end wall including an annular area of weakness therein curcumscribing said aperture to facilitate flexion of said end wall adjacent said aperture.

2. The improved container assembly of claim 1, wherein said surface portions of said connector element are defined by a shoulder within said bore adjacent said second opening in said connector element for seating against said valve stem in force transmitting relationship to said valve stem.

3. The improved container assembly of claim 2, wherein said bore is defined by first side wall portions tapered outwardly adjacent said second opening in a direction toward said second opening, said shoulder being defined by said side wall portions of said bore.

4. The improved container assembly of claim 3, wherein said bore is further defined by second side wall portions tapering outwardly adjacent said first opening in a direction toward said first opening.

5. An improved remotely operated pressurized container assembly including the combination of a pressurized container provided with an upstanding rim concentrically surrounding an upstanding hollow valve stem for releasing the pressurized contents therefrom in response to shifting of the valve stem relative to the container from a normal disarmed mode position to a depressed armed mode position, a remote delivery nozzle for selectively controlling the release of said contents from said container, conduit means coupled with said remote delivery nozzle for carrying said contents from said container to said remote delivery nozzle, wherein the improvement comprises:

means for releasably connecting said valve stem with said conduit means, said connecting means including (1) cap means for enclosing said valve stem and including an annular peripheral edge frictionally engaging said upstanding rim of said container whereby to removably mount said cap means on said container, said cap means including an aperture therein, (2) a connector element extending through said aperture in said cap means and secured to the latter, said connector element having a bore therethrough defining first and second openings therein, said first opening being flowably coupled with said conduit means, said valve stem being sealingly received within said bore and extending through said second opening in said connector element, said connector element further including surface portions adapted to engage said valve stem and force the latter to engage said valve stem and force the latter to shift from said disarmed mode position thereof to said armed mode position thereof when said cap means is installed on said container, and (3) means circumscribing said connector element for providing a seal between said cap means and said connector element to prevent escape of the contents of said container from said cap means through said aperture into the surrounding atmosphere, said connector element is cylindrical and is provided with an annular notch in the circumferential side walls thereof which includes a first shoulder area, and said seal means comprises an O-ring circumscribing said connector element and disposed within said notch, said O-ring being seated against said first shoulder area and sealingly engaging the interior surface area of said cap means surrounding aperture therein, said notch in said connector element including a second shoulder area spaced from said first shoulder area, and the diameter of the cross-section of said connector element is marginally greater than the diameter of said aperture in said cap means, at least portions of said cap means surrounding said aperture therein being disposed within said notch in said connector element and held captive between said O-ring and said second shoulder area whereby to secure said connector element to said cap means.

* * * * *